US007048595B2

(12) United States Patent
Nakamura et al.

(10) Patent No.: US 7,048,595 B2
(45) Date of Patent: May 23, 2006

(54) CIRCUIT BOARD CONNECTOR

(75) Inventors: Keiichi Nakamura, Yokkaichi (JP); Hajime Kawase, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/049,818

(22) Filed: Feb. 3, 2005

(65) Prior Publication Data

US 2005/0221687 A1 Oct. 6, 2005

(30) Foreign Application Priority Data

Apr. 2, 2004 (JP) ..... 2004-028001

(51) Int. Cl.
*H01R 13/42* (2006.01)

(52) U.S. Cl. ..... 439/751; 439/75

(58) Field of Classification Search ..... 439/751, 439/75, 45, 48, 78, 733.1, 79, 80, 943, 444, 439/741, 389–425, 736, 876
See application file for complete search history.

(56) References Cited

U.S. PATENT DOCUMENTS

| | | | | |
|---|---|---|---|---|
| 5,286,218 | A * | 2/1994 | Sakurai et al. | 439/444 |
| 6,015,316 | A * | 1/2000 | Matsubara | 439/736 |
| 6,305,949 | B1 * | 10/2001 | Okuyama et al. | 439/75 |
| 6,835,074 | B1 * | 12/2004 | Sakata | 439/79 |
| 6,866,523 | B1 * | 3/2005 | Yamashita | 439/79 |

FOREIGN PATENT DOCUMENTS

JP 2002-110278 4/2002

* cited by examiner

*Primary Examiner*—Gary F. Paumen
*Assistant Examiner*—Edwin A. Leon
(74) *Attorney, Agent, or Firm*—Gerald E. Hespos; Anthony J. Casella

(57) ABSTRACT

Terminal fittings (40) extend through a back wall (22) of a receptacle (21) of a housing (20). The terminal fittings (40) have receiving portions (43) that bulge out sideways along a width direction. The receiving portions (43) have jig receiving surfaces (45) exposed at the inner surface of the back wall (22) of the receptacle (21). A pressing surface (61) of a pressing jig (60) contacts the jig receiving surfaces (45) so that a pressing force of the pressing jig (60) is received directly by the terminal fittings (40).

11 Claims, 14 Drawing Sheets

CIRCUIT BOARD CONNECTOR

BACKGROUND OF THE INVENTION

1. Field of the Invention

The invention relates to a circuit board connector with terminal fittings to be connected with a circuit board.

2. Description of the Related Art

Japanese Unexamined Patent Publication No. 2002-110278 and FIG. 15 herein disclose a known circuit board connector. With reference to FIG. 15, the connector has a box-shaped housing 1 with a bottom plate 2. The connector also has terminal fittings 3, and projections 4 project sideways from each terminal fitting 3. The bottom plate 2 has mount holes 5, and each mount hole 5 has a stepped recess 6. The terminal fittings 3 are inserted through the mount holes 5 so that the projections 4 fit in the stepped recess 6 in the bottom plate 2. The terminal fitting 3 can be connected with a circuit board 7 by urging a pressing jig 8 against the upper surface of the bottom plate 2. Thus, a pressing surface 9 of the pressing jig 8 is moved towards the circuit board 7 and leading ends of the terminal fittings 3 are pressed into through holes 7A of the circuit board 7 for connection.

The pressing jig 8 can exert excessive pressing forces on upper walls 6A. As a result, the upper walls 6A of the housing 1 may be deformed.

The invention was developed in view of this problem and an object thereof is to prevent a housing from being deformed by a pressing jig.

SUMMARY OF THE INVENTION

The invention relates to a circuit board connector for mounting on a circuit board that has through holes formed therein. The connector has a housing with a receptacle for receiving a mating connector. The receptacle has a back wall generally opposed to the circuit board. The connector further includes terminal fittings that extend through the back wall. A press-in portion is formed on each terminal fitting rearward of the back wall and a receiving portion bulges out transversely between the opposite ends of each terminal fitting. Each receiving portion has a jig-receiving surface that faces into the receptacle. A jig is urged against the inner surface of the back wall of the receptacle and against the jig-receiving surfaces of the terminal fittings to move the housing towards the circuit board and to push the press-in portions into the through holes of the circuit board.

Each receiving portion preferably has a retaining portion. Mount holes are formed in the back wall and have stepped recesses for contacting the retaining portion and stopping the terminal fitting at a specified insertion depth in the mount hole.

The terminal fittings are pierced through the back wall of the receptacle and the jig presses the inner surface of the back wall of the receptacle and the jig receiving surfaces of the terminal fittings to press the press-in portions of the terminal fittings into the through holes of the circuit board for connection. Accordingly, the pressing jig is placed on both the inner surface of the back wall of the receptacle and on the jig receiving surfaces of the terminal fittings so that at least part of the pressing force of the pressing jig acts directly on the terminal fittings. Thus, the pressing jig is not likely to deform the housing during a pressing operation.

The stepped recesses contact the retaining portions to stop the terminal fittings at the specified insertion depth during the insertion of the terminal fittings. Thus, the terminal fittings are positioned and are prevented from coming out the mount holes in an inserting direction.

DESCRIPTION OF THE PREFERRED EMBODIMENTS

Figure 1:
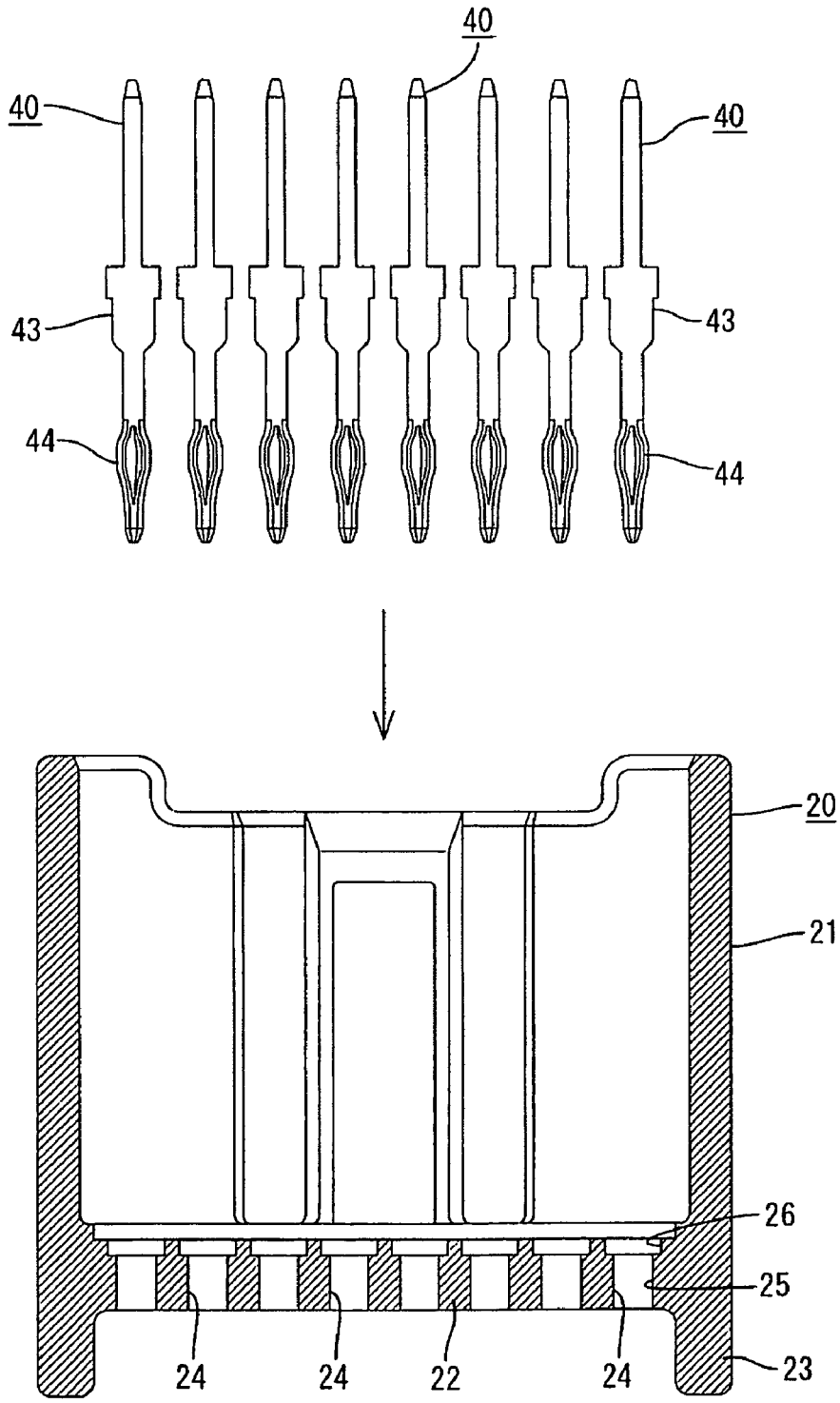
FIG. 1 is a section of a housing showing a state before terminal fittings are mounted in a connector according to a first embodiment of the invention.

A circuit board connector according to a first embodiment of the invention is identified by the numeral 10 in FIGS. 1 to 8. The terms upper and lower are used herein as a convenient frame of reference for the orientation of the connector 10 shown in FIGS. 1 to 5. However, these terms are not intended to imply a required gravitational orientation for the connector 10.

The connector 10 has a housing 20 made of a synthetic resin. The housing 20 has a rectangular tubular receptacle 21 with an open upper surface for receiving a mating connector housing. A circuit board 50 is arranged below the housing 20, so that the mating connector housing is connected in a direction substantially normal to the circuit board 50. The receptacle 21 has a back wall 22 aligned substantially parallel with the circuit board 50. A spacing wall 23 defines a specified spacing between the back wall 22 of the receptacle 21 and the circuit board 50. The housing 20 has a fixing member (not shown) for fixedly mounting the housing 20 on the circuit board 50.

Figure 6:
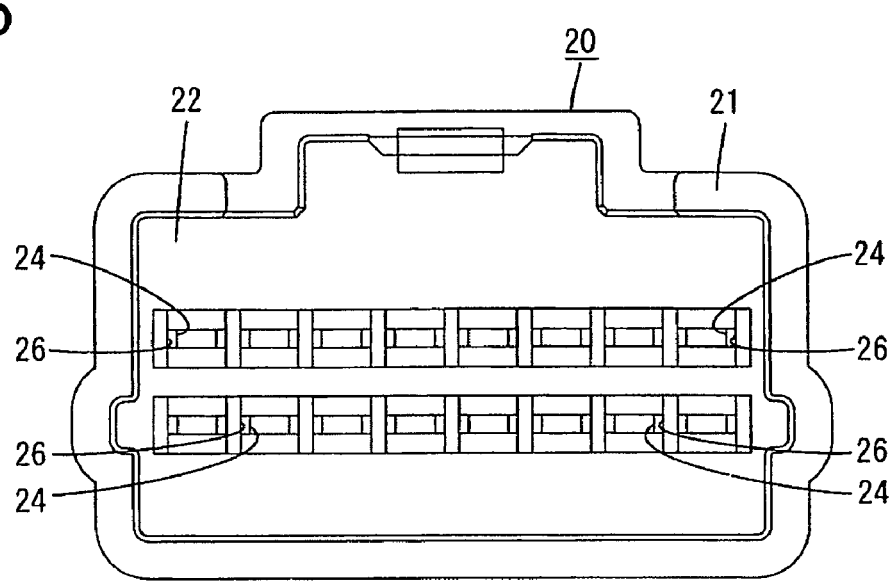
FIG. 6 is a front view of the housing showing the state before the terminal fittings are mounted.
Figure 7:
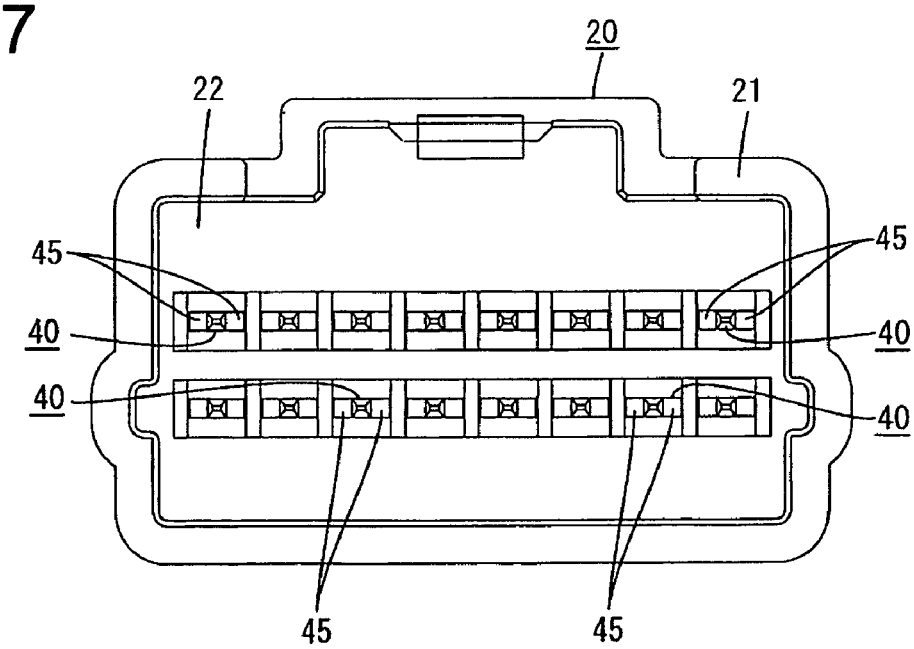
FIG. 7 is a front view of the housing having the terminal fittings mounted therein.

The back wall 22 of the receptacle 21 has a plurality of substantially identical mount holes 24. As shown in FIG. 6, the mount holes 24 are arranged side by side along a width direction at each of a plurality of stages to define a rectangular lattice of mount holes 24 when viewed from the front. Each mount hole 24 has a press-contact portion 25 of substantially constant width along the longitudinal direction. The press-contact portions 25 open in the lower surface of the back wall 22 of the receptacle 21. Each mount hole 24 also has a stepped recess 26 that is wider than the press-contact portion 25. The stepped recesses 26 open in the upper surface of the back wall 22 of the receptacle 21. As shown in FIG. 6, the stepped recesses 26 are arrayed on the same straight lines extending along the width direction when the housing 20 is viewed from the front.

Figure 8A:
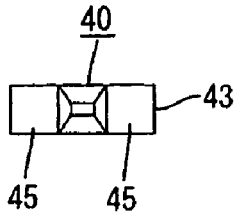
FIGS. 8(A), 8(B) and 8(C) are a plan view, a front view and a side view of the terminal fitting.
Figure 8B:
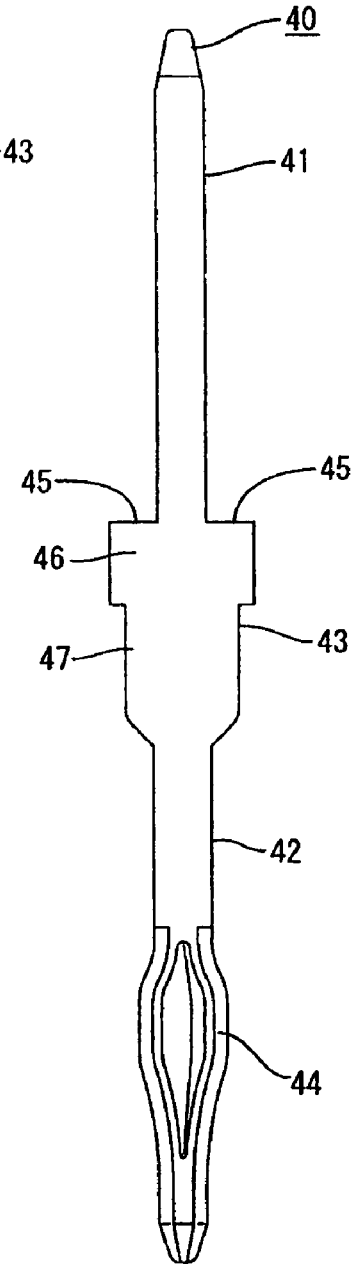
Figure 8C:
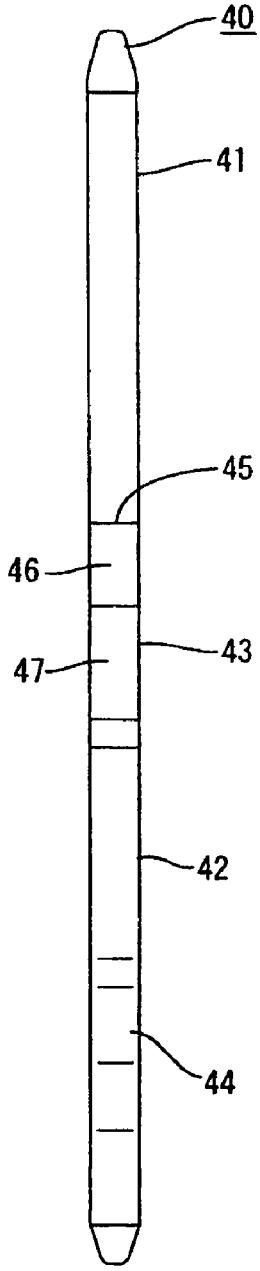

The connector 10 further includes press-fit terminal fittings 40 that are to be connected with the circuit board 50. Each terminal fitting 40 is in the form of a rectangular bar with a flat cross section that extends substantially straight as shown in FIG. 8. Additionally, each terminal fitting 40 has a terminal connecting portion 41 at one end, a board-connecting portion 42 at the other end, and a receiving portion 43 at a substantially longitudinal middle position. The terminal connecting portion 41 has substantially the same shape as the board-connecting portion 42, but is slightly narrower than the board-connecting portion 42. A press-in portion 44 is formed at a leading end of the board-connecting portion 42 and is inserted into a through hole 51 of the circuit board 50. The press-in portion 44 is resiliently deformable inward and outward, and is compressed while being pressed into the through hole 51. A widening restoring force of the press-in portion 44 then establishes electrical connection with a contact formed on the inner circumferential surface of the through hole 51 and holds the press-in portion 44 in the through hole 51.

The receiving portion 43 bulges out in the width direction of the terminal fitting 40, and a jig-receiving surface 45 is defined at the upper end of the receiving portion 43. The jig receiving surfaces 45 are substantially horizontal and flat for closely contacting pressing surfaces 61 of the jig 60 that presses the terminal fitting 40 into the circuit board 50. A rectangular retaining portion 46 bulges out sideways at the upper end of the receiving portion 43, and a contacting portion 47 is formed at the lower end of the receiving portion 43. The lower end of the contacting portion 47 gradually tapers to the board-connecting portion 42. The contacting portion 47 is narrower than the retaining portion 46, but has a maximum width that is wider than the terminal-connecting portion 41 and the board-connecting portion 42. The contacting portion 47 can be pressed into contact with the press-contact portion 25 of the mount hole 24. The retaining portion 46 engages the stepped recess 26 of the mount hole 24 as the terminal fitting 40 is inserted through the mount hole 24.

Figure 5:
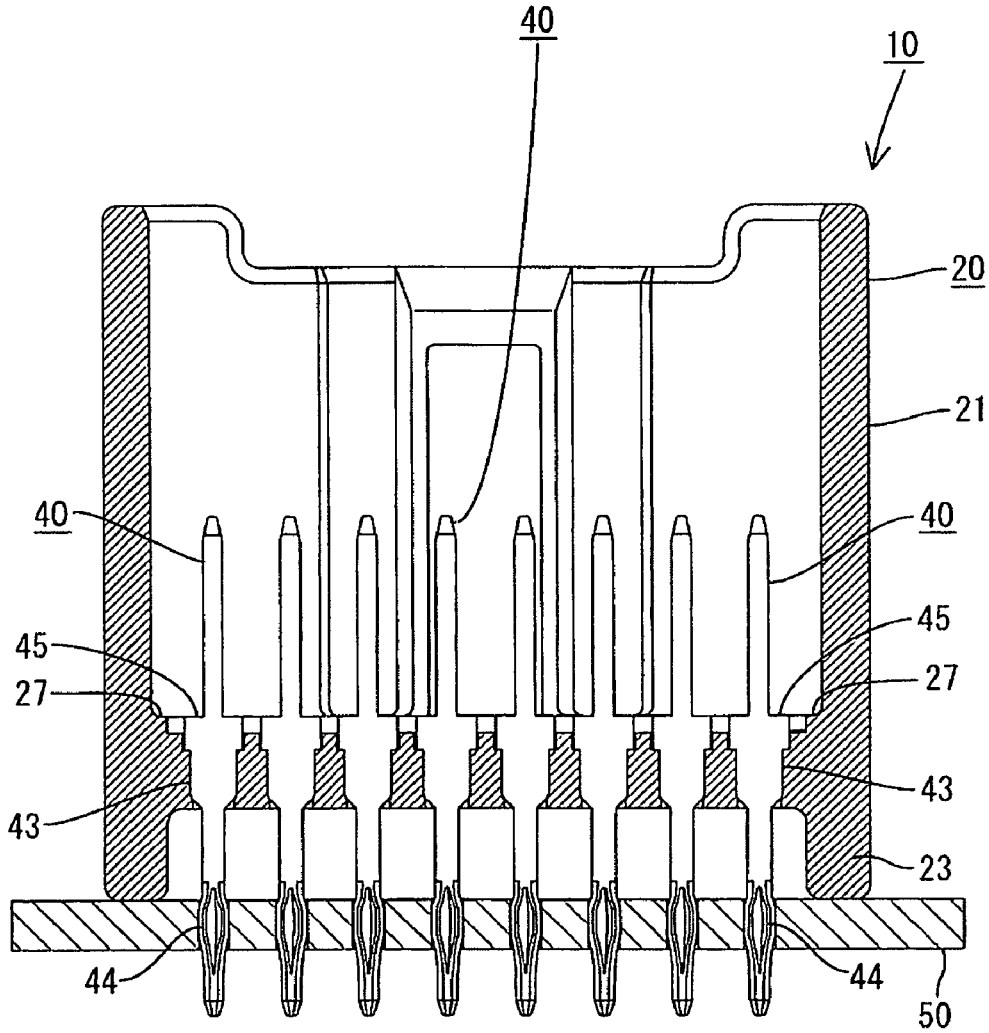
FIG. 5 is a section of the housing showing a state where the terminal fittings are connected with the circuit board.

The receiving portions 43 are pressed into the mount holes 24 in the back wall 22 of the receptacle 21 so that the terminal-connecting portions 41 project into the receptacle 21 and the leading ends of the board connecting portions 42 project towards the circuit board 50, as shown in FIG. 5. At this time, the retaining portions 46 of the receiving portions 43 fit into the stepped recesses 26 of the mount holes 24 to prevent the terminal fittings 40 from coming downward out of the mount holes 24. Additionally, the jig receiving surfaces 45 of the receiving portions 43 are exposed at the upper surface of the back wall 22 of the receptacle 21, thereby enabling contact with the pressing jig 60. More specifically, the jig receiving surfaces 45 of the receiving portions 43 are higher than the upper surface of the back wall 22, and substantially upper halves of the retaining portions 46 are exposed at the upper surface of the back wall 22. A stepped surface 27 is formed in an inner surface of the receptacle 21 substantially at the same height as the jig receiving surfaces 45 of the receiving portions 43, so that a pressing force of the pressing jig 60 also is distributed to the stepped surface 27 while connecting the terminal fittings 40 with the circuit board 50.

Figure 3:
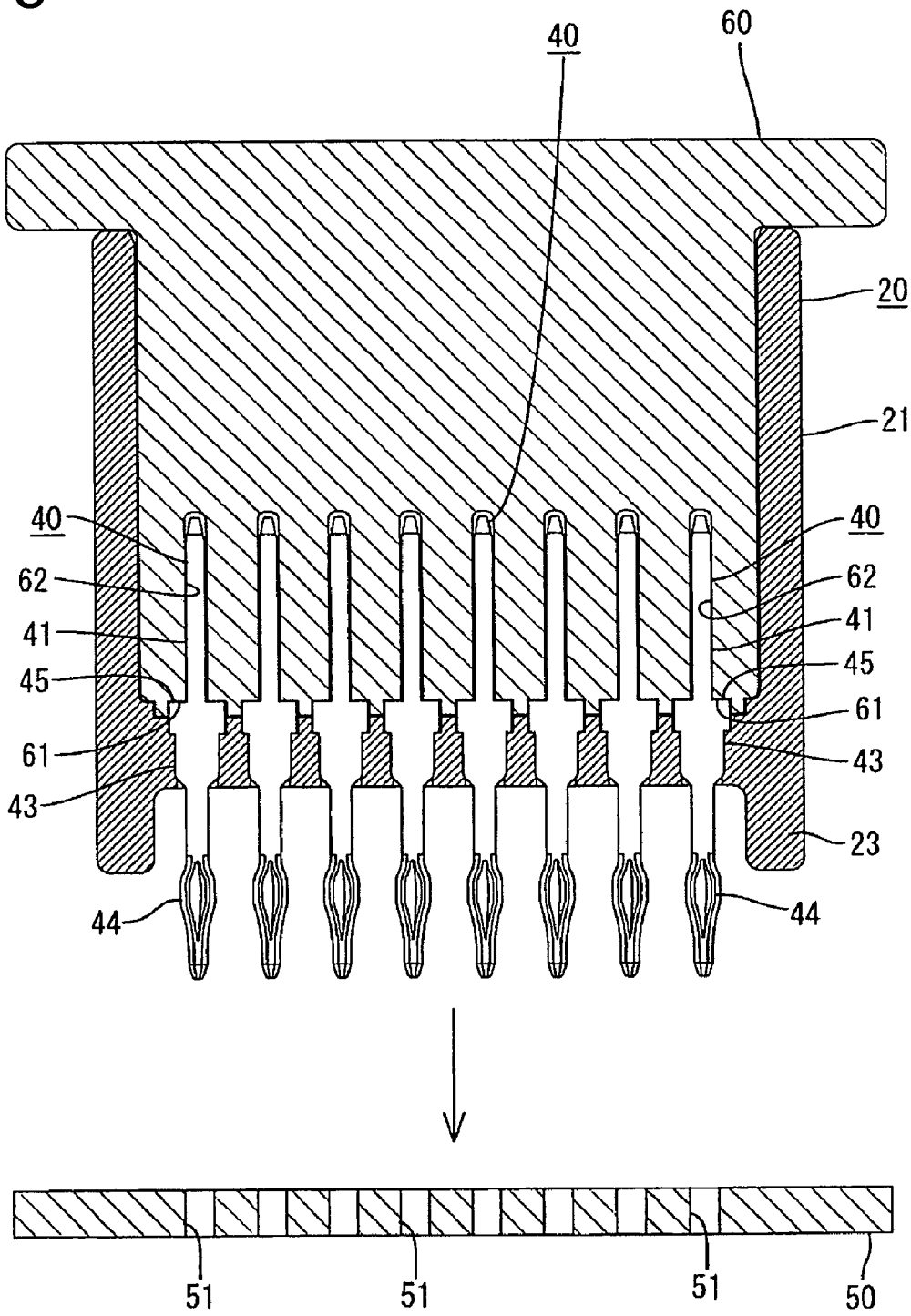
FIG. 3 is a section of the housing showing a state before the terminal fittings are connected with a circuit board.

As shown in FIG. 3, the pressing jig 60 is shaped to fit into the receptacle 21 and can move down along a connecting direction of the mating connector to press the upper surface of the back wall 22 of the receptacle 21. The pressing jig 60 has recesses 62 for accommodating the terminal connecting portions 41 of the terminal fittings 40 without making widthwise shaking movements. The pressing surfaces 61 are formed on the inner surfaces of the respective recesses 62 for contacting the jig receiving surfaces 45 of the receiving portions 43.

Figure 2:
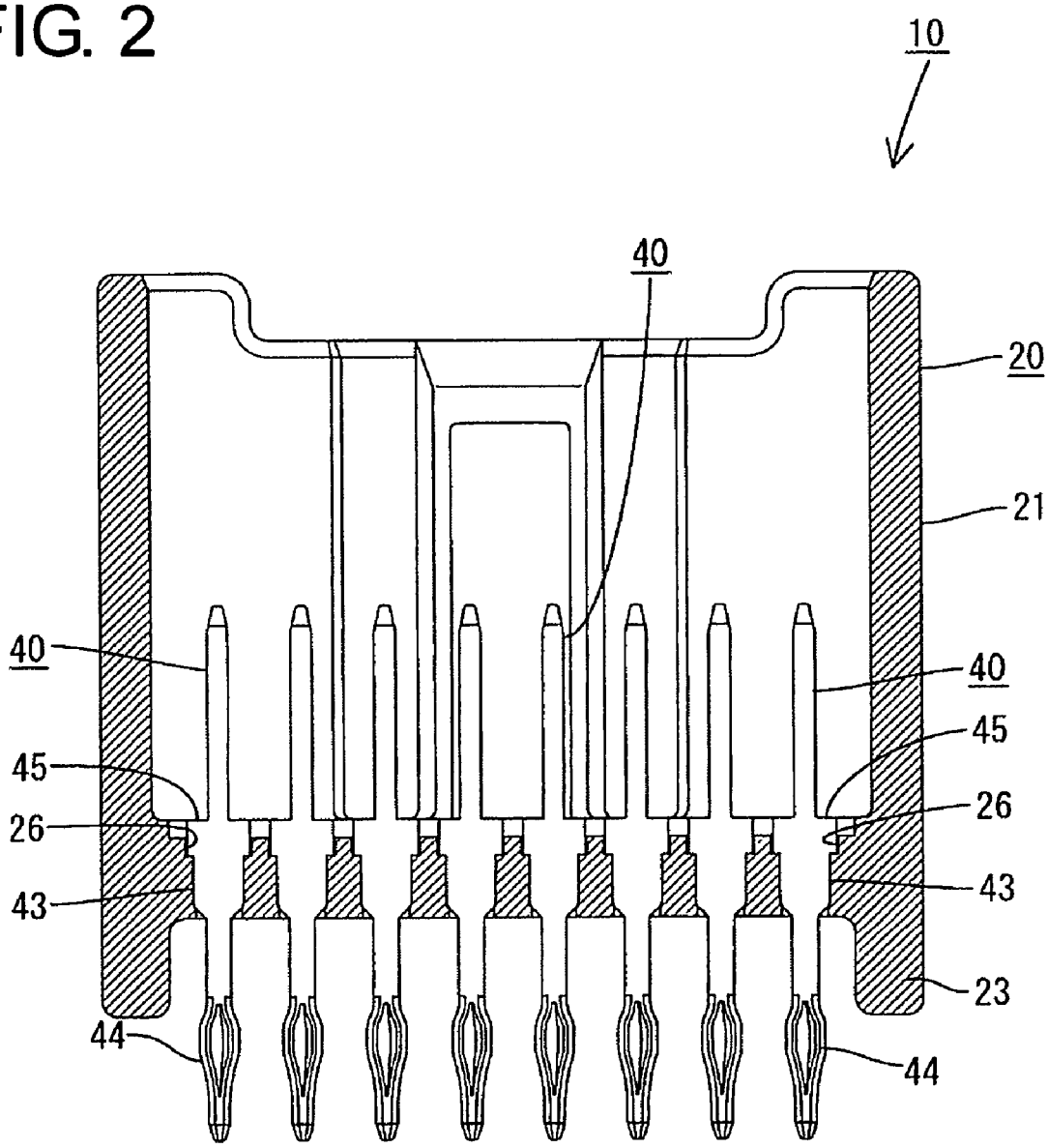
FIG. 2 is a section showing the housing having the terminal fittings mounted therein.

The connector 10 is assembled by pressing the terminal fittings 40 from above and along the direction of the arrow of FIG. 1 into the respective mount holes 24 in the back wall 22 of the receptacle 21. The terminal fittings 40 are positioned at a proper insertion depth, as shown in FIG. 2, and the contact of the retaining portions 46 and the stepped recesses 26 of the mount holes 24 prevent the terminal fittings 40 from coming downward out of the mount holes 24. In this position, the jig receiving surfaces 45 of the receiving portions 43 are arrayed side by side and are exposed at the upper surface of the back wall 22 of the receptacle 21.

Figure 4:
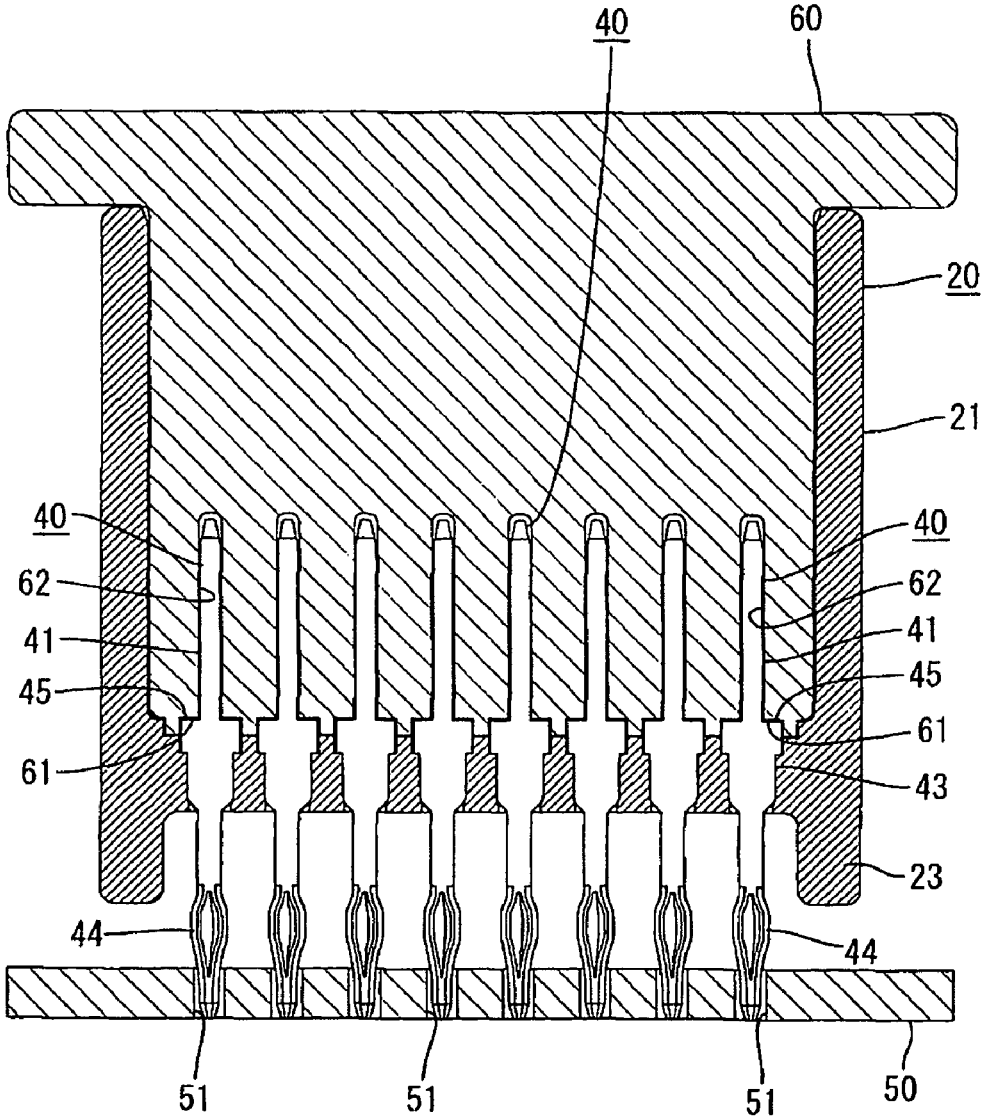
FIG. 4 is a section of the housing showing an intermediate state of the connection of the terminal fittings with the circuit board.

The pressing jig 60 then is inserted into the receptacle 21 from above and the leading end of the pressing jig 60 is placed on the upper surface of the back wall 22 of the receptacle 21, as shown in FIG. 3. At this time, the pressing surfaces 61 of the pressing jig 60 closely contact the jig receiving surfaces 45 of the receiving portions 43, while the terminal connecting portions 41 escape into the recesses 62 of the pressing jig 60. The pressing jig 60 then is moved towards the circuit board 50 along the direction of the arrow of FIG. 3. The upper surface of the back wall 22 of the receptacle 21 and the jig receiving surfaces 45 of the receiving portions 43 then are pressed by the pressing jig 60, as shown in FIG. 4. As a result, the leading ends of the board connecting portions 42 enter the corresponding through holes 51 of the circuit board 50. Further pressing of the jig 60 moves the press-in portions 44 into the through holes 51 of the circuit board 50 with a specified contact pressure. The pressing jig 60 then is moved up and is separated from the housing 20. As a result, the terminal fittings 40 are fixed in substantially upright postures between the back wall 22 of the receptacle 21 and the circuit board 50 as shown in FIG. 5.

The housing of the unillustrated mating connector connected with ends of wires is connected with the housing 20 to establish electrical connection between the mating connector and the circuit board 50.

As described above, the pressing surface 61 of the pressing jig 60 is placed on the jig receiving surfaces 45 of the terminal fittings 40 to move the terminal fittings 40 towards the circuit board 50 and to press the press-in portions 44 of the terminal fittings 40 into the through holes 51 of the circuit board 50 for connection. Thus, the pressing force of the pressing jig 60 acts directly on the terminal fittings 40 to prevent deformation of the housing 20 due to the pressing operation of the pressing jig 60.

Further, the stepped recesses 26 in the mount holes 24 contact the retaining portions 46 to stop the terminal fittings 40 at the specified insertion depth. Thus, the terminal fittings 40 are positioned securely and prevented from coming out of the mount holes 24 in the inserting direction.

A second embodiment of the invention is described with reference to FIGS. 9 to 13. In the second embodiment, the positions of stepped recesses 26 in mount holes 24 and positions of retaining portions 46 in receiving portions 43 of terminal fittings 40 differ from those of the first embodiment. However, the other construction is substantially same as in the first embodiment. Thus, no repeated description is given on the other construction, and the similar elements merely are identified by the same reference numerals.

The stepped recesses 26 of the second embodiment are formed in the inner surfaces of the mount holes 24 and open in the lower surface of a back wall 22 of a receptacle 21. On the other hand, the receiving portions 43 of the terminal fittings 40 of the second embodiment penetrate through the mount holes 24 of the back wall 22 of the receptacle 21 so that upper ends of the receiving portions 43 project up from the upper surface of the back wall 22. Rectangular retaining portions 46 bulge out along the width direction at the bottom ends of the receiving portions 43. Contacting portions 47 are formed above the retaining portions 46, and are narrower than the retaining portions 46 but wider than terminal connecting portions 41 and board connecting portions 42. The contacting portions 44 are of substantially constant width over their entire length, and substantially horizontal and flat jig receiving surfaces 45 are provided on the upper ends of the contacting portions 47. The jig receiving surfaces 45 are exposed at the upper surface of the back wall 22, as in the first embodiment, but are slightly narrower than those of the first embodiment.

Figure 9:
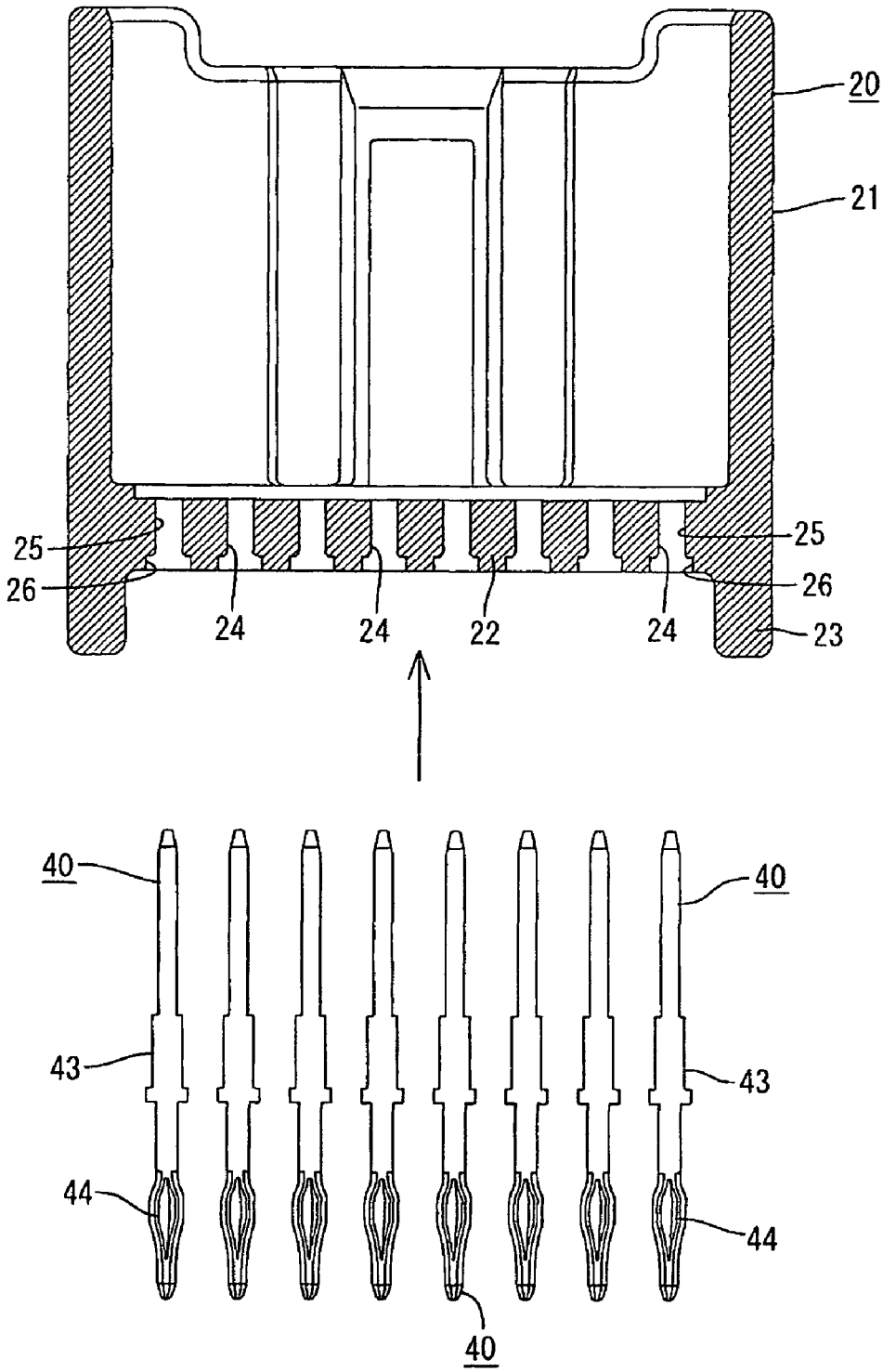
FIG. 9 is a section of a housing showing a state before terminal fittings are mounted in a connector according to a second embodiment of the invention.
Figure 10:
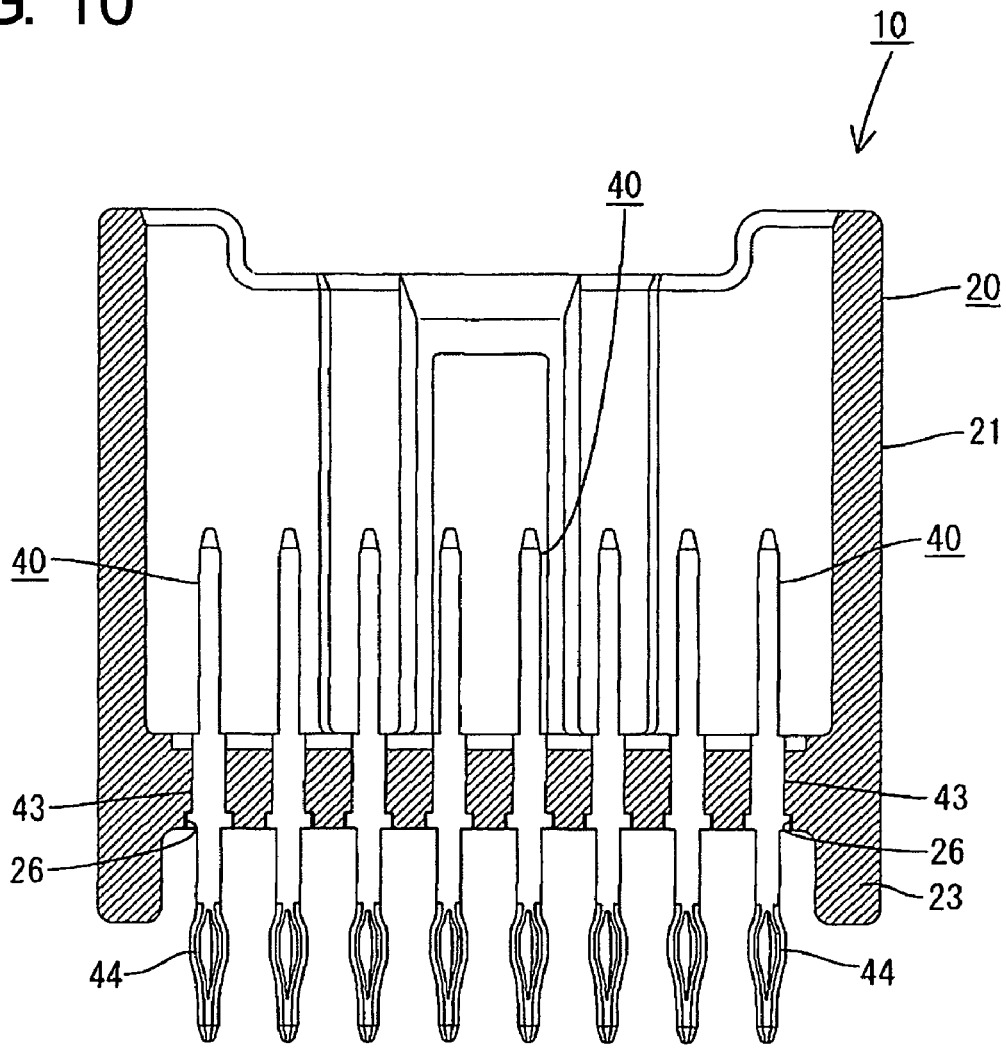
FIG. 10 is a section of the housing with the terminal fittings therein.
Figure 11:
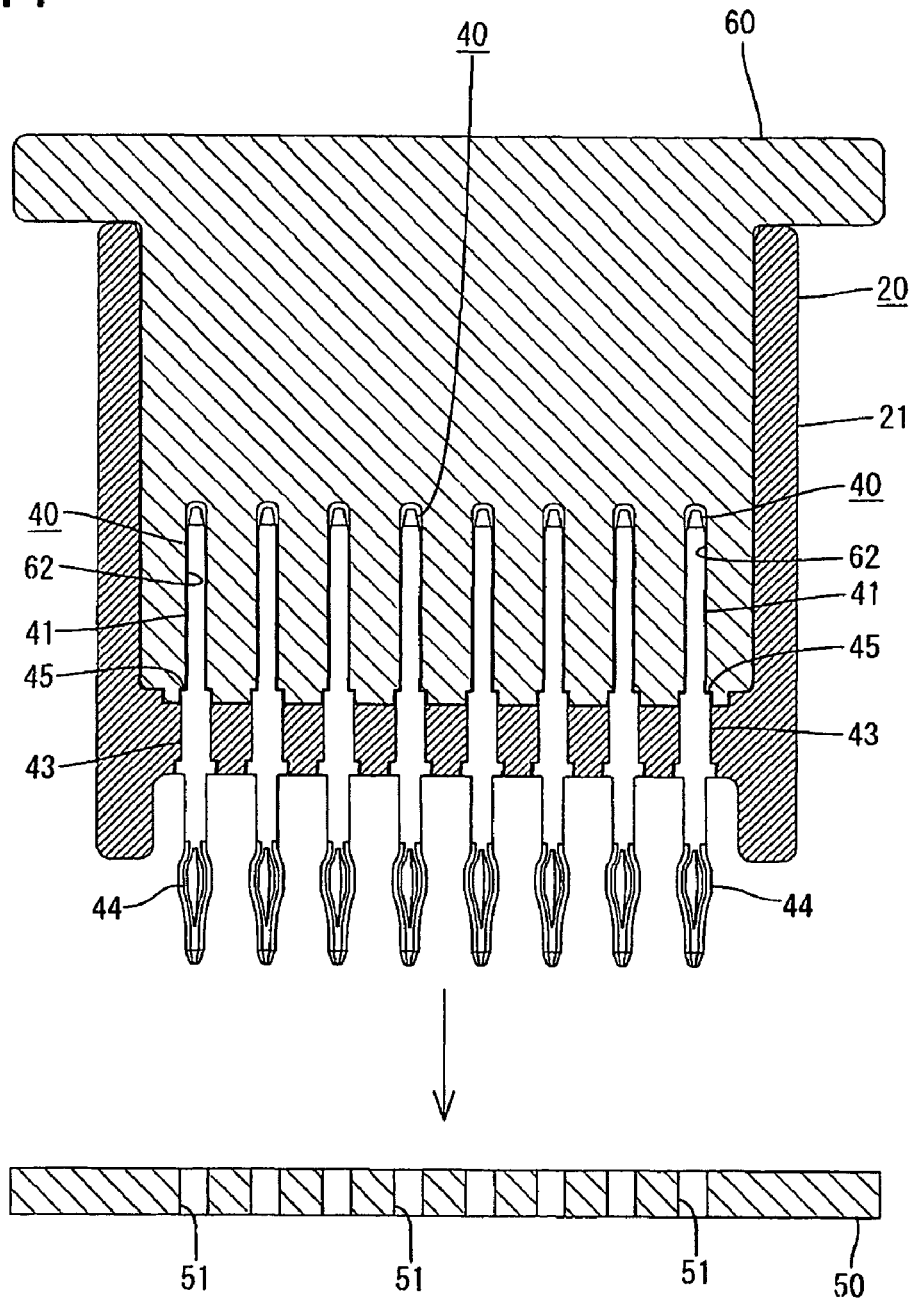
FIG. 11 is a section of the housing showing a state before the terminal fittings are connected with the circuit board.
Figure 12:
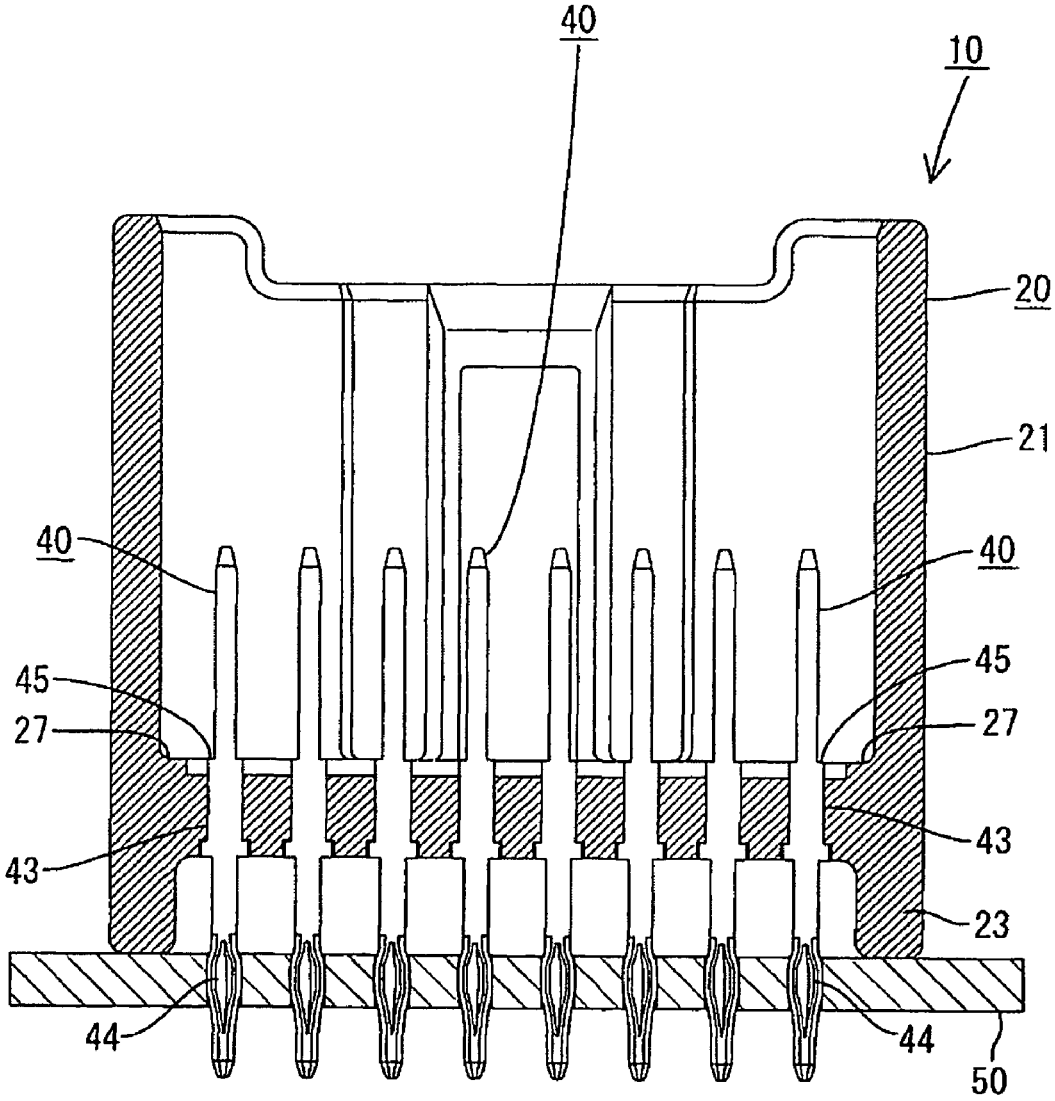
FIG. 12 is a section of the housing showing a state where the terminal fittings are connected with the circuit board.
Figure 13A:
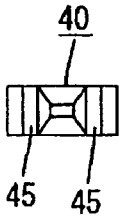
FIGS. 13(A), 13(B) and 13(C) are a plan view, a front view and a side view of the terminal fitting.
Figure 13B:
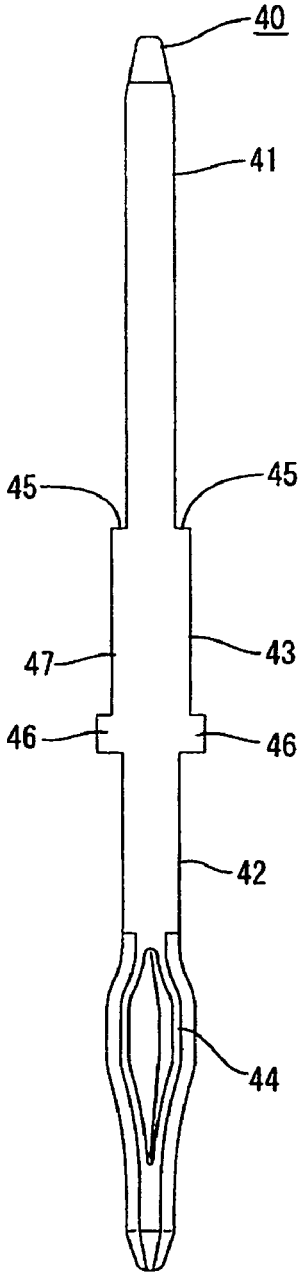
Figure 13C:
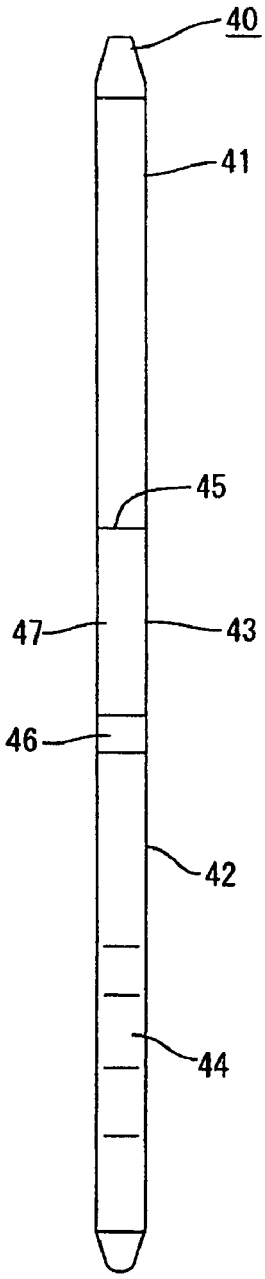

The terminal fittings 40 are pressed into the respective mount holes 24 of the back wall 22 of the receptacle 21 from below along the direction of the arrow of FIG. 9. The respective terminal fittings 40 then are positioned at a proper insertion depth and are prevented from coming upward out of the mount holes 24 by the contact of the retaining portions 46 with the stepped recesses 26. The jig receiving surfaces 45 of the receiving portions 43 are arrayed transversely side by side and are exposed at the upper surface of the back wall 22 of the receptacle 21. The pressing jig 60 then is inserted into the receptacle 21 from above to place the leading end surface of the pressing jig 60 on the upper surface of the back wall 22 of the receptacle 21 as shown in FIG. 11. The pressing jig 60 then is moved toward the circuit board 50 along the direction of the arrow of FIG. 11. The upper surface of the back wall 22 of the receptacle 21 and the jig receiving surfaces 45 of the receiving portions 43 are pressed by the pressing jig 60. As a result, the press-in portions 44 of the board connecting portions 42 are pressed to a proper depth into the corresponding through holes 51 of the circuit board 50. The pressing jig 60 then is moved up and separated from the housing 20.

According to the second embodiment, the stepped recesses 26 are formed in the inner surfaces of the mount holes 24 to make openings in the lower surface of the back wall 22 of the receptacle 21. Thus, the terminal fittings 40 are prevented from coming upward out of the housing 20 and can be positioned and held at the proper insertion depth by fitting the retaining portions 46 of the terminal fittings 40 into the stepped recesses 26. More particularly, the retaining portions 46 bite in the upper walls of the stepped recesses 26 upon being pressed by the pressing jig 60 because the upper walls of the stepped recesses 26 are above the retaining portions 46. However, according to the second embodiment, the pressing force of the pressing jig 60 given to the terminal fittings 40 is received directly by the jig receiving surfaces 45 of the receiving portions 43. Thus, a deformation of the housing 20 resulting from the pressed retaining portions 46 can be avoided.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Figure 14:
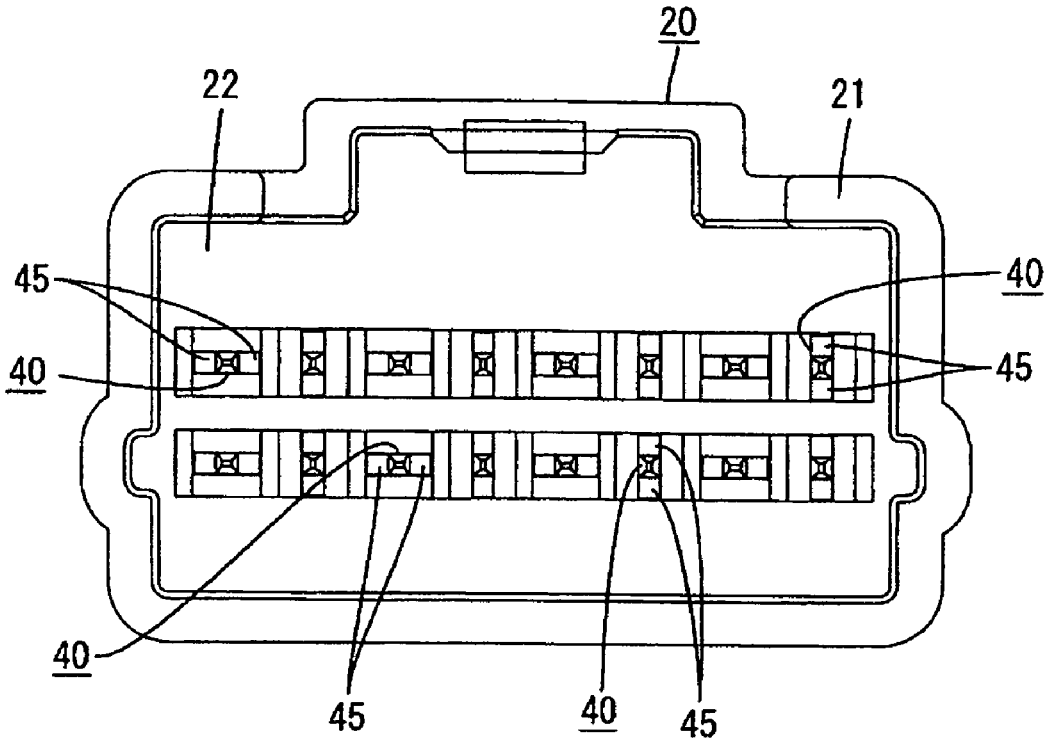
FIG. 14 is a front view of a housing of a connector according to another embodiment.
Figure 15:
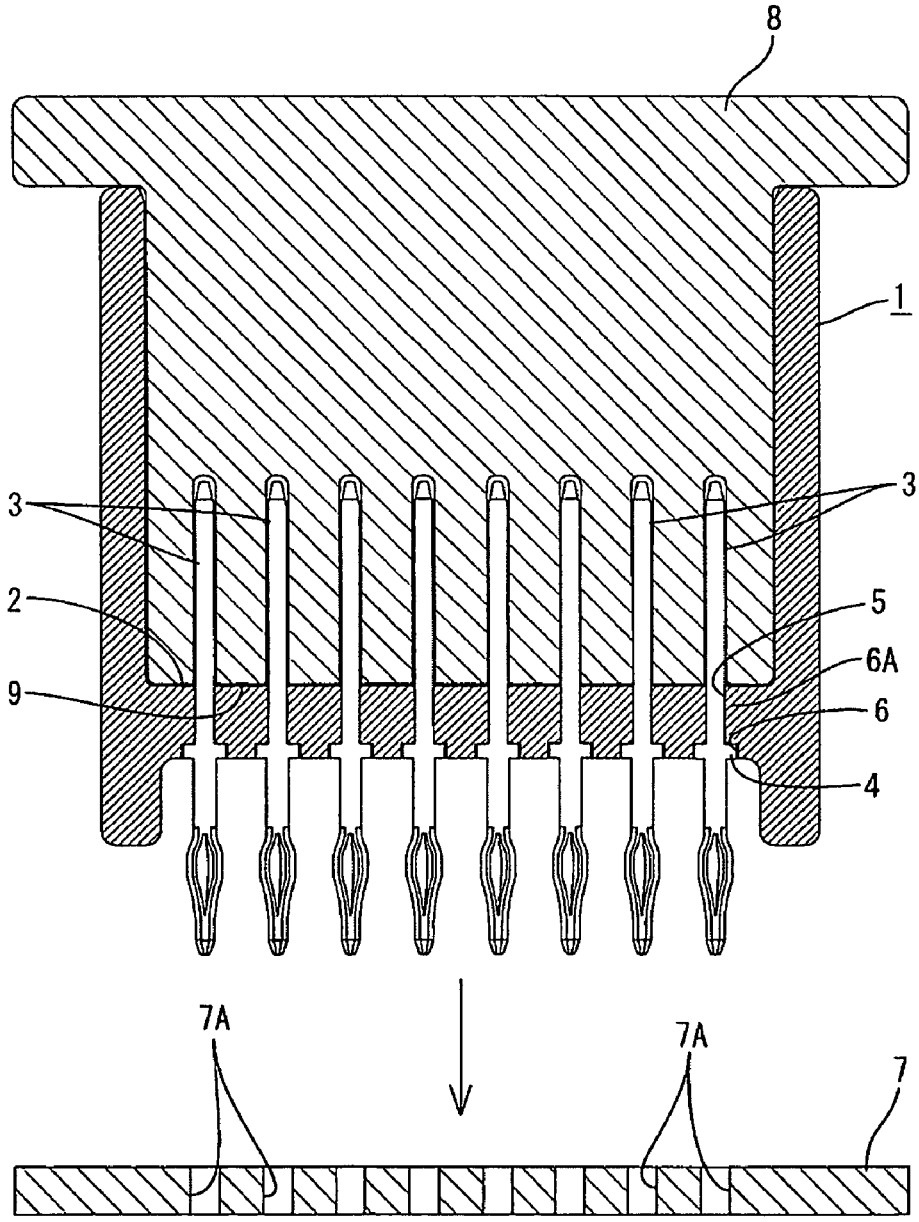
FIG. 15 PRIOR ART
FIG. 15 is a section of a housing showing a state before terminal fittings are mounted in a prior art connector.

According to the invention, upon mounting the terminal fittings 40 into the housing 20, the terminal fittings 40 may be arranged to alternately align the jig receiving surfaces 45 of the receiving portions 43 along the width direction and along a direction substantially normal to widthwise direction as shown in FIG. 14. This enables the designing of the housing 20 having a reduced width.

Although the terminal fittings are fixed by being pressed into the mount holes formed in the back wall of the receptacle in the foregoing embodiments, they may be fixed in the back wall of the receptacle by insert molding according to the invention.

What is claimed is:

1. A circuit board connector, comprising:

a housing formed with a receptacle for receiving a housing of a mating connector, the receptacle having a back wall with a front surface facing forwardly into the receptacle, at least on forwardly open main recess formed in the front surface of the back wall, a plurality of mount holes extending through portions of the back wall having the forwardly open main recess, each of said mount holes being formed with a stepped recess that is cross-sectionally larger than adjacent areas of the mount hole; and terminal fittings being mounted through the back wall so that connecting portions of the terminal fittings project into the receptacle, press-in portions being formed on the terminal fittings rearward of the back wall and configured for being pressed into through holes in a circuit board, each of said terminal fittings having a receiving portion bulging out sideways along a width direction and disposed in the receiving portion of a corresponding one of the through holes, a retaining portion disposed in the stepped recess of the corresponding one of the stepped recesses and a jig-receiving surface exposed at the back wall of the receptacle, the jig-receiving surfaces of the terminal fittings being in the forwardly open main recess in the back wall for receiving a pressing force of a pressing jig for urging the press-in portions into the through holes of the circuit board.

2. The circuit board connector of claim 1, wherein the receiving portion being adjacent the respective retaining portion, the retaining portions contacting the stepped recesses to stop the terminal fittings at a specified insertion depth in the mount holes.

3. The connector of claim 2, wherein the stepped recesses face into the receptacle.

4. The connector of claim 3, wherein the jig-receiving surface is adjacent the retaining portion.

5. The connector of claim 2, wherein the stepped recesses face towards the circuit board.

6. The connector of claim 5, wherein the jig-receiving surface is adjacent the retaining portion.

7. A method of mounting a connector to a circuit board, comprising the following steps:

providing a housing formed with opposite front and rear ends and a receptacle open forwardly on the housing for receiving a housing of a mating connector, the receptacle having a back wall with a forwardly facing front surface, a forwardly open main recess formed in the front surface of the back wall and a plurality of spaced apart mount holes extending through portions of the back wall at the forwardly open main recess;

positioning terminal fittings in the housing so that press-in portions of the terminal fittings project rearward of the back wall and so that jig-receiving surfaces of the terminal fittings are exposed in the main recess in the receptacle of the housing;

moving a pressing jig into the main recess of the receptacle and against the jig-receiving surfaces of the terminal fittings; and urging the pressing jig against the jig-receiving surfaces of the terminal fittings for forcing the press-in portions of the terminal fittings into receiving portions in the circuit board.

8. The method of claim 7, wherein the step of positioning the terminal fittings comprises moving the terminal fittings partly through the mount holes.

9. The method of claim 8, wherein each mount hole has a stepped recess and wherein each terminal fitting has a retaining portion, the step of moving the terminal fittings partly through the mount holes comprises urging the retaining portion of each said terminal fitting against the stepped recess for positioning the terminal fittings at proper insertion positions.

10. The method of claim 9, wherein the terminal fittings are moved partly through the mount holes from a side of the back wall facing into the receptacle.

11. The method of claim 9, wherein the terminal fittings are moved partly through the mount holes from a side of the back wall opposite the receptacle.

* * * * *

UNITED STATES PATENT AND TRADEMARK OFFICE

CERTIFICATE OF CORRECTION

PATENT NO. : 7,048,595 B2
APPLICATION NO. : 11/049818
DATED : May 23, 2006
INVENTOR(S) : Keiichi Nakamura It is certified that error appears in the above-identified patent and that said Letters Patent is hereby corrected as shown below:

(30) Foreign Application Priority Data

Feb. 4, 2004 (JP) ..... 2004-028001

Signed and Sealed this

Eighth Day of August, 2006

JON W. DUDAS
*Director of the United States Patent and Trademark Office*